US006059660A

United States Patent [19]

Takada et al.

[11] Patent Number: 6,059,660

[45] Date of Patent: May 9, 2000

[54] JOYSTICK TYPE MULTIFUNCTIONAL CONTROLLER

[75] Inventors: Yoshihide Takada; Masayuki Ogawa; Ichiro Kataoka, all of Susono, Japan

[73] Assignee: Yazaki Corporation, Tokyo, Japan

[21] Appl. No.: 09/015,666

[22] Filed: Jan. 29, 1998

[30] Foreign Application Priority Data

Jan. 30, 1997 [JP] Japan ..... 9-016812

[51] Int. Cl.[7] ..... A63F 9/24

[52] U.S. Cl. ..... 463/38; 463/36; 463/37; 345/161; 273/148 B

[58] Field of Search ..... 463/36–39; 273/148 B; 244/237; 345/156, 161

[56] References Cited

U.S. PATENT DOCUMENTS

| | | | |
|---|---|---|---|
| 3,771,037 | 11/1973 | Bailey, Jr. | 318/580 |
| 4,469,330 | 9/1984 | Asher | 127/148 |
| 4,587,510 | 5/1986 | Kim | 338/128 |
| 4,748,441 | 5/1988 | Brzezinski | 345/161 |
| 5,589,828 | 12/1996 | Armstrong | 341/20 |
| 5,738,352 | 4/1998 | Ohkubo et al. | 273/148 |

FOREIGN PATENT DOCUMENTS 1-120302 8/1989 Japan .

*Primary Examiner*—Valencia Martin-Wallace
*Assistant Examiner*—Corbett B. Coburn
*Attorney, Agent, or Firm*—Oblon, Spivak, McClelland, Maier & Neustadt, P.C.

[57] ABSTRACT

When an operational unit is inclined in an X- or Y-direction, an universal support mechanism and a rotation angle detection mechanism are used to detect the inclined direction and angle. The detection results are supplied to a computer system (not shown). When the operational unit is pushed down at the neutral position, a push detection switch detects it. The detection result is also supplied to the computer system. In addition, a rotation angle detection switch 10 detects rotation of the operational unit about a Z-axis. The detection result is supplied to the computer system.

4 Claims, 6 Drawing Sheets

JOYSTICK TYPE MULTIFUNCTIONAL CONTROLLER

BACKGROUND OF THE INVENTION

1. Technical Field

The present invention relates to a joystick type multifunctional controller that is used for computer systems or the like.

2. Related Art

Mouse devices and joystick type controllers are well-known coordinate input devices for computer systems.

Of these, the joystick type controllers comprises a controller housing, a joystick, an universal support mechanism, and an angle detection mechanism. The controller housing is formed in a rectangular shape. The joystick is placed in a slot formed in a top surface of the controller housing such that the joystick can be universally shifted in an inclined manner. The universal support mechanism is placed in the controller housing to support the joystick such that the latter can be universally shifted in an inclined manner in the X- and Y-direction. The angle detection mechanism is for detecting an inclined angle and an inclined direction. The angle detection mechanism detects the direction and angle of inclination of the joystick, when shifted, and supplies a detection result to a computer system.

In this event, as the universal support mechanism, there is typically provided an universal support mechanism 106. The universal support mechanism comprises, as shown in FIG. 1, a Y-axis member 104 having an elongate slot 102 through which a joystick 103 is passed. The elongate slot 102 is formed in the central portion of the Y-axis member 104. The Y-axis member 104 is rotatable about an Y-axis 101. There is also provided an X-axis 105 to support the joystick 103 in a rotatable manner while being passed through the elongate slot 102 in the Y-axis member 104. The X-axis 105 is rotatably passed through the central portion of the Y-axis member 104. As the angle detection mechanism, the one is used that uses a potentiometer or the like to detect an angle of inclination of the joystick 103. As shown in FIG. 2, the Y-axis member 104 and the X-axis 105 are rotated depending on the angle and direction of the inclination when the joystick 103 is shifted as shown in FIG. 2. The potentiometer detects the rotation angle for the Y-axis member 104 and the X-axis, thereby determining the direction and angle of inclination of the joystick 103.

There are other joystick type controllers that use an universal support mechanism 118 in which a indented hole 110 is formed at a central portion as shown in FIG. 3. This controller is formed of a base 113 and a joystick 117. The base 113 has X-axis guiding slots 111 and Y-axis guiding slots 112 on a periphery of the indented hole 110. The joystick 117 has a spherical member 114 formed at a predetermined portion. The spherical member 114 has X and Y-axes 115 and 116, formed on the surface of the spherical member 114. The spherical member 114 is rotatably received by the indented hole 110 in the base 113. In FIG. 3, the universal support mechanism 118 is upside down for clearer illustration of the components.

The universal support mechanism 118 rotates the spherical member 114 contained in the indented hole 110 in the base 113 when the joystick 117 is biased in the X- or Y-direction. The universal support mechanism 118 downward moves the spherical member 114 along the indented hole 110 when the joystick 117 is biased in the Z-direction.

The conventional joystick type controllers of the above-mentioned configuration have the following problems.

The joystick type controller having the universal support mechanism 106 as shown in FIG. 1 has the Y-axis member 104 and the X-axis that completely prevents the joystick 103 from being shifted in the upper and lower direction (in the Z-direction). Thus the joystick 103 is not available for turning on/off the switch by shifting it in the Z-direction. Therefore, the controller cannot be a multifunctional one.

The joystick type controller having the universal support mechanism 118 as shown in FIG. 3 has the spherical member 114 of the joystick 117 that is rotatably and movably contained in the indented hole 110 in the base 113. When the joystick 117 is pushed down when it is at a neutral position as shown in FIG. 4, the spherical member 114 is shifted downward in the indented hole 110. A switch button (not shown) may then be turned on/off by the lower portion of the joystick 117.

On the other hand, as shown in FIG. 5, the direction of joystick push is displaced away from the Z-axis by the amount of the gap between the X-axis 115 and the Y-axis 116 on the spherical member 114 and the X-axis guiding slot 111 and the Y-axis guiding slot 112, respectively, formed in the base 113, if the joystick 117 is at a position other than the neutral position. The switch cannot be activated and thus no trouble will occur under such circumstances.

However, such joystick type controller is also desired to be more multifunctional and therefore, there is a strong demand towards a joystick type controller that meets such requirements.

SUMMARY OF THE INVENTION

With respect to the above, an object of the present invention is to provide a joystick type multifunctional controller with functions and capabilities to turn on/off a switch and to adjust various analog amounts by means of rotating an operational unit provided on the joystick about the Z-axis, thereby permitting various switching operations including inclination in the X- and Y-directions as well as pushing in the Z-directions and rotation about the Z-axis to provide multifunction.

In order to achieve the above-mentioned object, there is provided a joystick type multifunctional controller comprising: a stick; an universal support mechanism that supports the stick such that the stick is universally inclined in the X- and Y-directions, shifted in the Z-directions, and prevented from being rotated about the Z-axis; an operation detection mechanism for detecting an inclined direction of the stick, an inclined angle, and whether the joystick is pushed down; an operational unit rotatably passed through the upper portion of the stick, the operational unit being rotated about the central axis of the stick when being rotationally biased about the Z-axis; and a rotation angle detection switch for detecting a rotation angle of the operational unit.

In the above-mentioned configuration, the joystick type multifunctional controller according to the present invention uses the universal support mechanism to hold the stick extending in the upright direction such that the stick is universally inclined in the X- and Y-directions, shifted in the Z-directions, and prevented from being rotated about the Z-axis and also uses the operation detection mechanism to detect the inclined direction of the stick, the inclined angle, and whether the joystick is pushed down. In addition, when the operational unit that is rotatably passed through the upper portion of the stick is rotationally biased about the Z-axis and rotated about the central axis of the stick, the rotation angle detection switch detects a rotation angle of the operational unit. This permits various switching operations including inclination in the X- and Y-directions as well as pushing in the Z-directions and rotation about the Z-axis to provide multifunction.

In a preferred embodiment of the present invention, the rotation angle detection switch comprises: a disk plate fixedly provided at a position that is lower by a predetermined distance than the upper end of the stick; a plurality of switch contacts on the periphery of the disk plate; a sliding piece fixed to the lower portion of a cylinder forming the operational unit; and a slide contact provided on the sliding piece at one end thereof, the slide contact being to successively contact with the switch contacts when the cylinder rotates and, in turn, the sliding piece rotates.

In a preferred embodiment of the present invention, the universal support mechanism comprises: a first U-shaped groove plate formed of a stick rotation prevention block and two supporting plates, the stick rotation prevention block having a predetermined thickness and having an elongate slot formed in the central portion thereof and the supporting plates being integrally formed of the stick rotation prevention block at the respective ends thereof, the first U-shaped groove plate being rotatably placed about the X-axis, the joystick being passed through the first U-shaped groove plate; and a second U-shaped groove plate formed of a long thin plate having an elongate slot formed in the central portion thereof, the second U-shaped groove plate being rotatably placed about the Y-axis, the stick being passed through the second U-shaped groove plate.

In a preferred embodiment of the present invention, said stick has a lower portion having a square pole shape and an upper portion having a cylindrical shape through which a ball is passed.

The nature, principle and utility of the invention will become more apparent from the following detailed description when read in conjunction with the accompanying drawings.

DESCRIPTION OF THE PREFERRED EMBODIMENTS

An embodiment of the present invention is described below with reference to the drawings.

Figure 1:
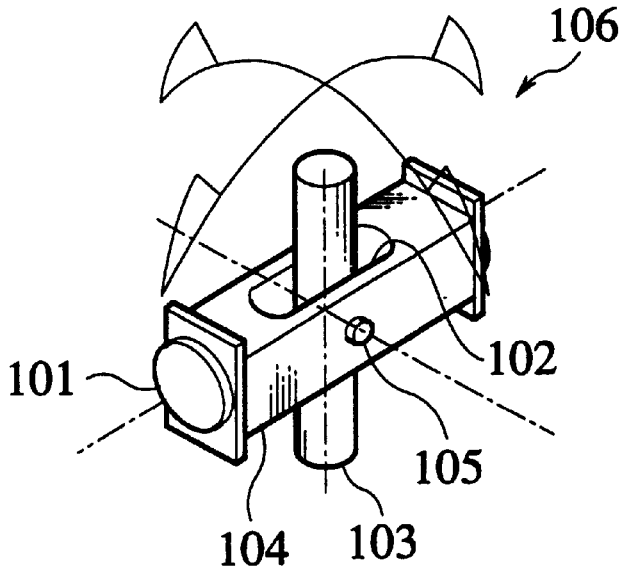
FIG.1 PRIOR ART
FIG. 1 is a perspective view illustrating essentials of a joystick type controller that is conventionally known.
Figure 2:
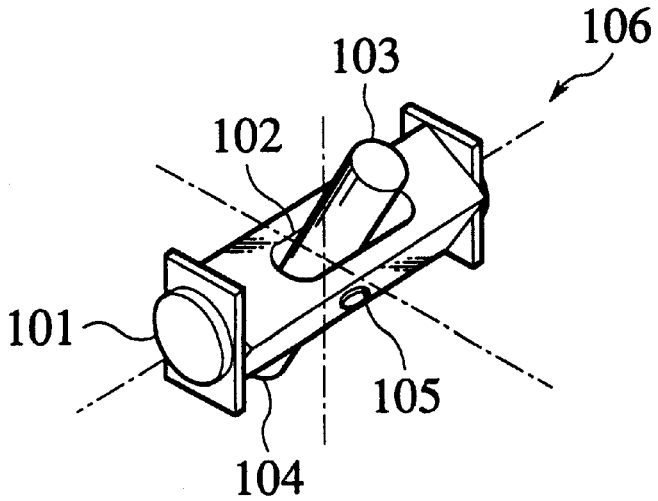
FIG.2 PRIOR ART
FIG. 2 is a perspective view for use in describing operation of an universal support mechanism shown in FIG. 1.
Figure 3:
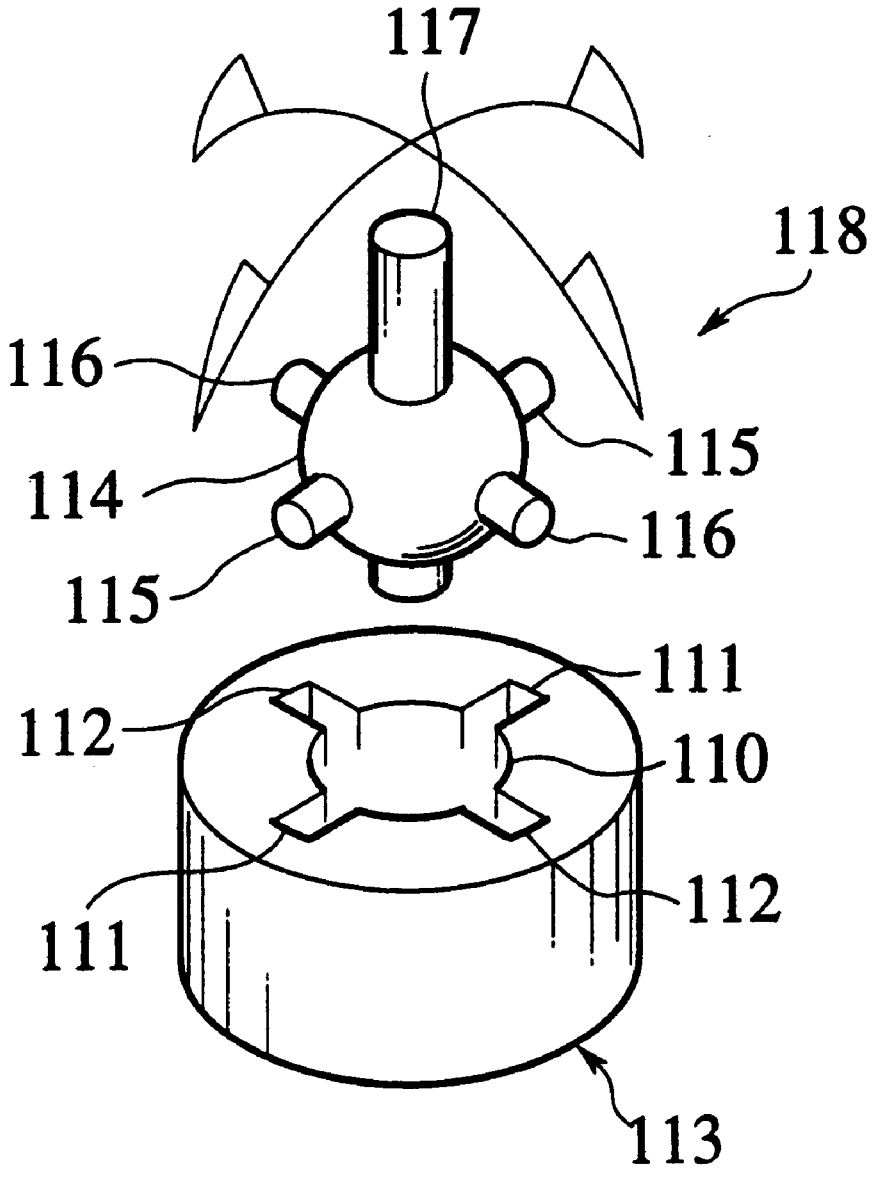
FIG.3 PRIOR ART
FIG. 3 is a perspective view illustrating essentials of another joystick type controller that is conventionally known.
Figure 4:
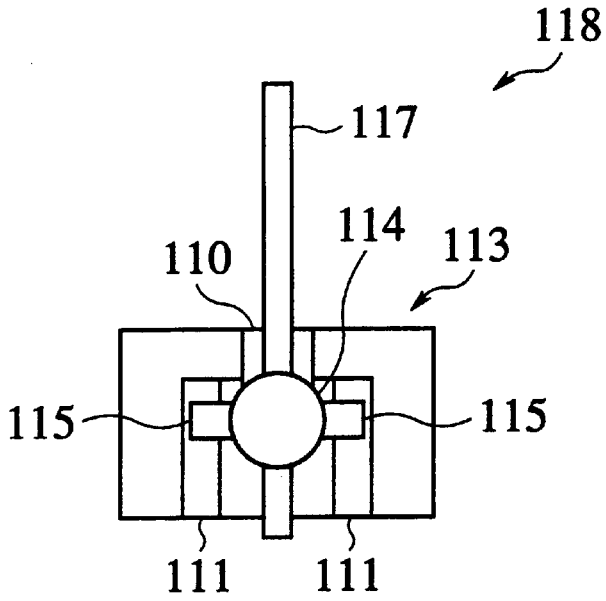
FIG.4 PRIOR ART
FIG. 4 is a schematic view for use in describing operation of an universal support mechanism shown in FIG. 3.
Figure 5:
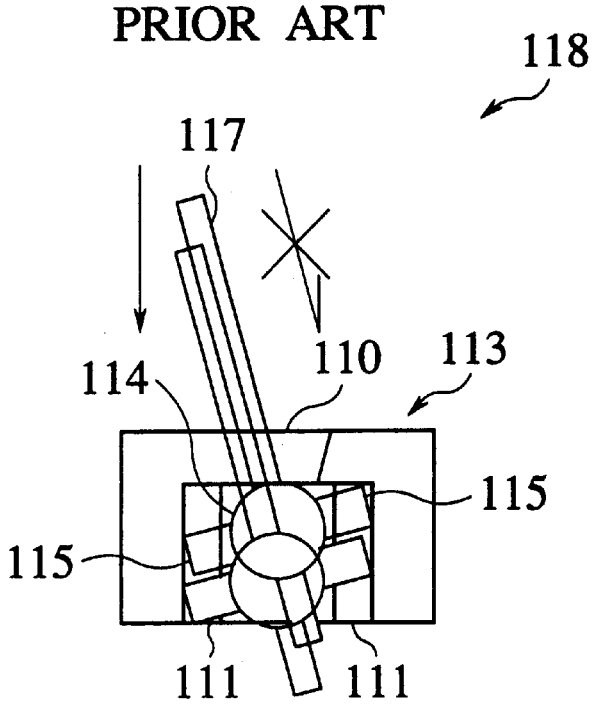
FIG.5 PRIOR ART
FIG. 5 is a schematic view for use in describing operation of an universal support mechanism shown in FIG. 3.
Figure 6:
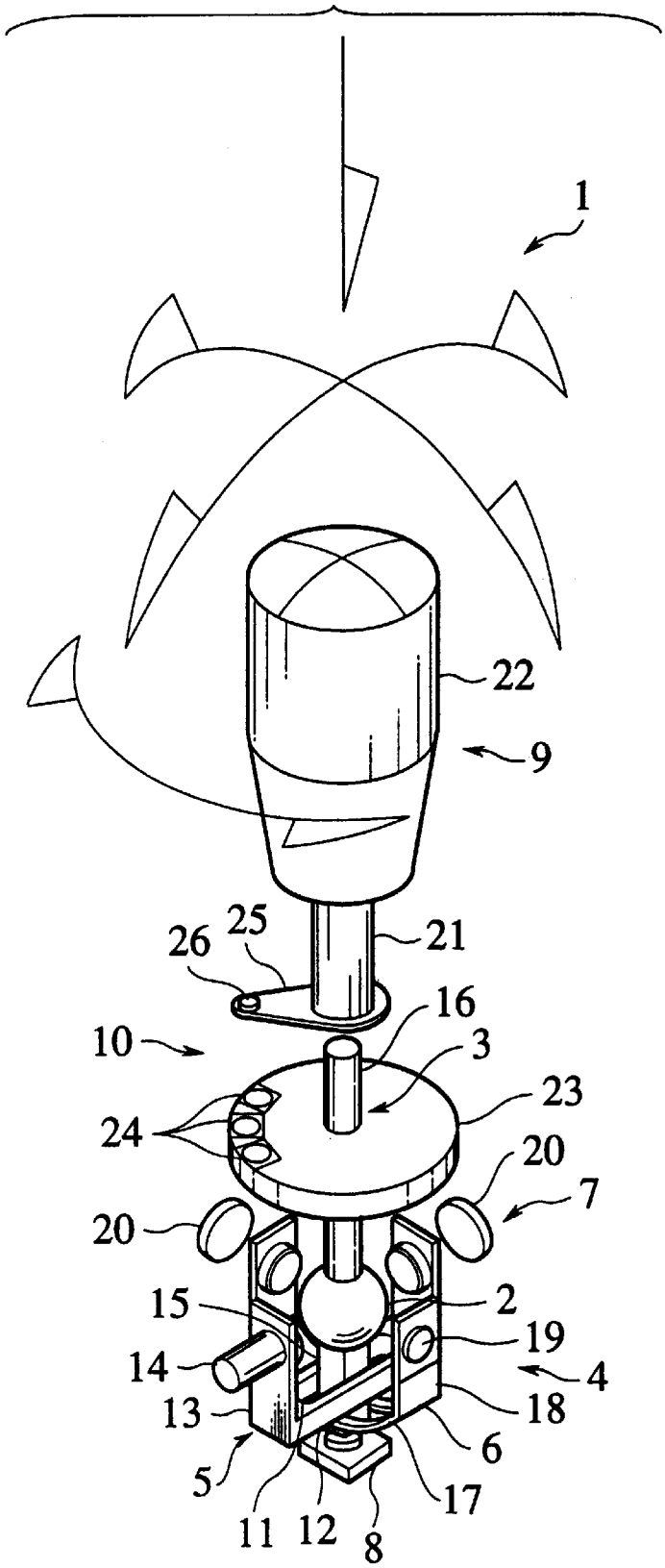
FIG. 6 is a partially exploded perspective view illustrating a joystick type multifunctional controller according to an embodiment of the present invention.

FIG. 6 is a partially exploded perspective view illustrating a joystick type multifunctional controller according to an embodiment of the present invention.

A joystick type multifunctional controller 1 illustrated in the figure comprises a controller housing (not shown), a joystick 3, an universal support mechanism 4, a rotation angle detection mechanism 7, a push detection switch 8, an operational unit 9, and a rotation angle detection switch 10. The joystick 3 is placed in a slot formed in the upper surface of the controller housing. More specifically, the joystick 3 is placed such that it is universally shifted in the Z-direction, as well as inclined in the X- and Y-directions about a spherical member 2. The universal support mechanism 4 is placed within the controller housing to hold the joystick 3 such that the latter is universally inclined in the X- and Y-directions, shifted in the Z-directions, and prevented from being rotated about the Z-axis. The rotation angle detection mechanism 7 is also placed within the controller housing to detect a rotation angle of U-shaped groove plates 5 and 6 forming the universal support mechanism 4. The push detection switch 8 is positioned beneath the universal support mechanism 4 and is turned on/off by the lower end of the joystick 3 when the joystick 3 is pushed down in the Z-direction at a neutral position (not being biased in the X-direction or the Y-direction). The operational unit 9 is rotatably passed through the upper portion of the joystick 3. The rotation angle detection switch 10 detects a rotation angle of the operational unit 9 when it is rotated about the Z-axis.

When the operational unit 9 is inclined in the X- or Y-direction the universal support mechanism 4 and the rotation angle detection mechanism 7 are used to detect the inclined direction and angle. Detection results are supplied to a computer system (not shown). When the operational unit 9 is pushed down at the neutral position, the push detection switch 8 detects it. A detection result is also supplied to the computer system. In addition, the rotation angle detection switch 10 detects rotation of the operational unit 9 about the Z-axis. A detection result is supplied to the computer system.

Figure 7:
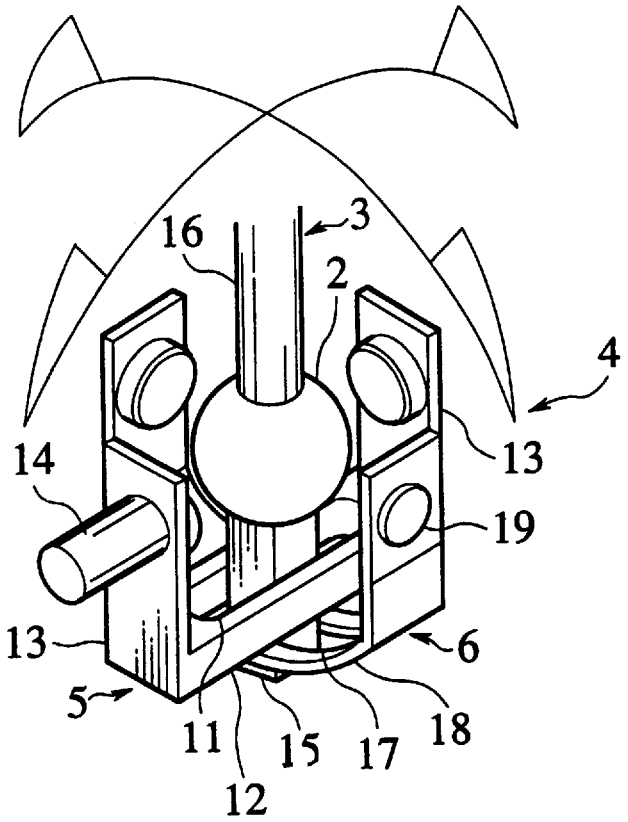
FIG. 7 is a perspective view illustrating in detail an exemplified configuration of an universal support mechanism used in a joystick type multifunctional controller shown in FIG. 6.
Figure 8:
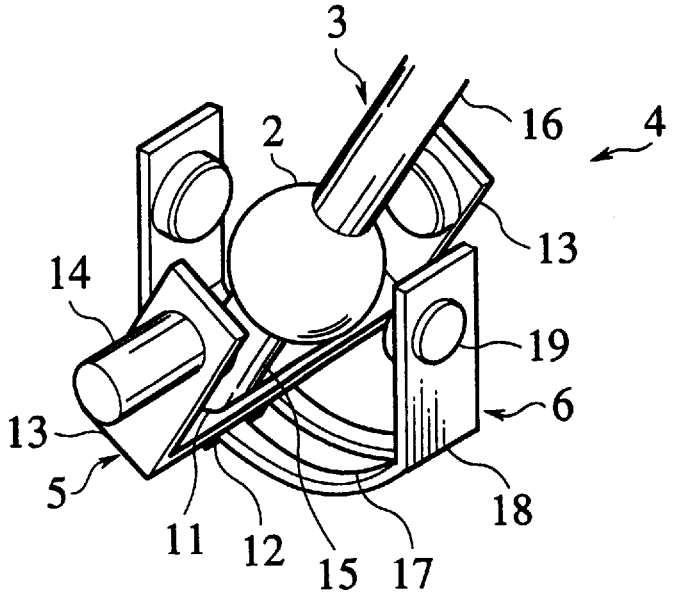
FIG. 8 is a perspective view for use in describing operation of an universal support mechanism shown in FIG. 7.
Figure 9:
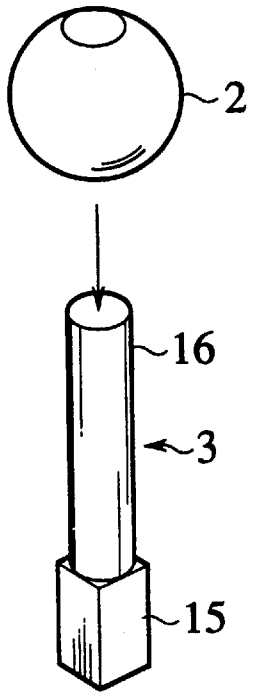
FIG. 9 is an exploded perspective view illustrating in detail an exemplified configuration of a joystick shown in FIG. 6.
Figure 10:
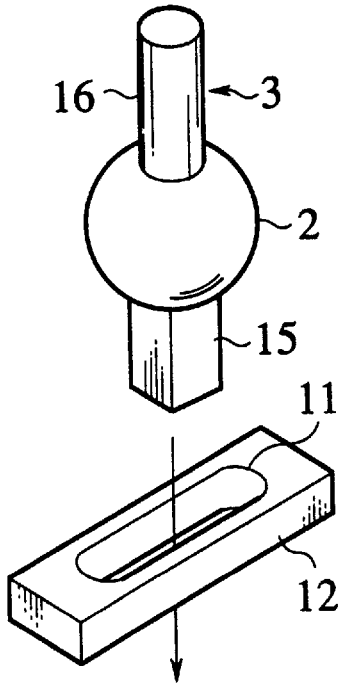
FIG. 10 is an exploded perspective view illustrating association between a joystick and an U-shaped groove plate of an universal support mechanism in FIG. 6.

In this event, the universal support mechanism 4 has a U-shaped groove plate 5 and a U-shaped groove plate 6 as shown in FIG. 7. The U-shaped groove plate 5 is formed of a stick rotation prevention block 12 and two supporting plates 13. The stick rotation prevention block 12 has a predetermined thickness and has an elongate slot 11 formed in the central portion thereof. The supporting plates 13 are integrally formed of the stick rotation prevention block 12 at the respective ends thereof. The U-shaped groove plate is rotatably placed about an X-axis 14. As shown in FIG. 9, the joystick 3 has a lower portion 15 having a square pole shape and an upper portion 16 having a cylindrical shape through which the ball (spherical member) 2 is passed. The lower portion 15 of the joystick 3 is passed through the U-shaped groove plate 5. The U-shaped groove plate 6 is formed of a long thin plate 18 having an elongate slot 17 formed in the central portion thereof. The U-shaped groove plate 6 is rotatably placed about a Y-axis 19. The lower portion 15 of the joystick 3 is passed through the U-shaped groove plate 6. When the operational unit 9 is biased in the X- or Y-direction while operating the joystick rotation prevention block 12 to prevent the joystick 3 from being rotated about the Z-axis as shown in FIG. 10 and the joystick 3 is inclined in the X- or Y-direction about the spherical member 2 as shown in FIG. 8, the U-shaped groove plates 5 and 6 are rotated in response to the inclination. When the operational unit 9 is biased downward, the joystick 3 is shifted in the Z-direction to push the button of the push detection switch 8 by the lower end of the joystick 3.

The rotation angle detection mechanism 7 is formed of a number of potentiometers 20 as shown in FIG. 6 each for detecting the rotation angle of the U-shaped groove plates 5 and 6. In response to the rotation of the U-shaped groove plates 5 and 6 of the universal support mechanism, the rotation angle detection mechanism 7 detects the rotation angles and supplies the detection results to the computer system as the inclined direction and angle for the joystick 3.

The operational unit 9 comprises a cylinder 21 and an operational grip 22. The cylinder 21 is rotatably passed through the upper portion of the joystick 3 about the Z-axis. The operational grip 22 is fixed to the upper portion of the cylinder 21. The joystick 3 is inclined in the X- and Y-directions through the cylinder 21 fixed to the operational grip 22 when the operational grip 22 is biased in the X- or Y-direction. When the operational grip 22 is pushed in the Z-direction, the joystick 3 is also pushed in the Z-direction through the cylinder 21. In addition, when the operational grip 22 is rotation biased about the Z-axis, then the joystick 3 rotates about the Z-axis at a fixed position.

The rotation angle detection switch 10 has a disk plate 23 fixedly provided at a position that is lower by a predetermined distance than the upper end of the joystick 3, a plurality of switch contacts 24 on the periphery of the disk plate 23, a sliding piece 25 fixed to the lower portion of the cylinder 21 forming the operational unit 9, and a slide contact 26 provided on the sliding piece 25 at one end thereof. The slide contact 26 is to successively contact with the switch contacts 24 when the cylinder 21 rotates and, in turn, the sliding piece 25 rotates. When the operational grip 22 is rotation biased about the Z-axis and rotates with respect to the joystick 3, the cylinder 21 and the sliding piece 25 are rotated that are fixed to the operational grip 22. The slide contact 26 on the sliding piece 25 comes in contact with either one of the switch contacts 24 to generate an electrical signal indicative of the rotation angle. The electrical signal is supplied to the computer system.

As described above, in the embodiment of the present invention, the universal support mechanism 4 is used to hold the joystick 3 such that the joystick 3 is universally inclined in the X- and Y-directions and shifted in the Z-directions while being prevented by the joystick rotation prevention block 12 forming the U-shaped groove plate 5 from being rotated about the Z-axis. When the operational grip 22 of the operational unit 9 rotatably passed through the joystick 3 is rotated about the Z-axis, this rotation is detected by the rotation angle detection switch 10. As a result, it is possible to turn on/off a switch and to adjust various analog amounts by means of rotating the operational unit 9 provided on the joystick 3 about the Z-axis, thereby permitting various switching operations including inclination in the X- and Y-directions as well as pushing in the Z-directions and rotation about the Z-axis to provide multifunction.

It should be understood that many modifications and adaptations of the invention will become apparent to those skilled in the art and it is intended to encompass such obvious modifications and changes in the scope of the claims appended hereto.

What is claimed is:

1. A joystick type multifunctional controller comprising:

a stick;

an universal support mechanism that supports said stick such that said stick is universally inclined in the X- and Y-directions, shifted in the Z-directions, and prevented from being rotated about the Z-axis;

an operation detection mechanism for detecting an inclined direction of said stick, an inclined angle, and whether the stick is pushed down;

an operational unit rotatably mounted on the upper portion of said stick, said operational unit being rotated about the central axis of said stick when being rotationally biased about the Z-axis; and a rotation angle detection switch for detecting a rotation angle of said operational unit.

2. A joystick type multifunctional controller as claimed in claim 1 wherein said rotation angle detection switch comprises:

a disk plate fixedly provided at a position that is lower by a predetermined distance than the upper end of said stick;

a plurality of switch contacts on the periphery of said disk plate;

a sliding piece fixed to the lower portion of a cylinder forming said operational unit; and a slide contact provided on the sliding piece at one end thereof, the slide contact being to successively contact with the switch contacts when the cylinder rotates and, in turn, the sliding piece rotates.

3. A joystick type multifunctional controller as claimed in claim 1 wherein said universal support mechanism comprises:

a first U-shaped groove plate formed of a stick rotation prevention block and two supporting plates, the stick rotation prevention block having a predetermined thickness and having an elongate slot formed in the central portion thereof and the supporting plates being integrally formed of the stick rotation prevention block at the respective ends thereof, said first U-shaped groove plate being rotatably placed about the X-axis, said joystick being passed through said first U-shaped groove plate; and a second U-shaped groove plate formed of a long thin plate having an elongate slot formed in the central portion thereof, said second U-shaped groove plate being rotatably placed about the Y-axis, said stick being passed through said second U-shaped groove plate.

4. A joystick type multifunctional controller as claimed in claim 3 wherein said stick has a lower portion having a square pole shape and an upper portion having a cylindrical shape which passes through a ball.

* * * * *